United States Patent [19]

Dixon

[11] 4,180,123

[45] Dec. 25, 1979

[54] MIXED-COMPONENT REFRIGERATION IN SHELL-TUBE EXCHANGER

[75] Inventor: Rolland E. Dixon, Bartlesville, Okla.

[73] Assignee: Phillips Petroleum Company, Bartlesville, Okla.

[21] Appl. No.: 768,515

[22] Filed: Feb. 14, 1977

[51] Int. Cl.[2] ..... F28B 9/00

[52] U.S. Cl. ..... 165/1; 62/11; 62/54; 62/114; 62/502

[58] Field of Search ..... 62/54, 114, 502, 512, 62/217, 218, 219, 220, 9, 11; 165/1

[56] References Cited

U.S. PATENT DOCUMENTS

| | | | |
|---|---|---|---|
| 1,921,163 | 8/1933 | Kenney et al. | 62/220 |
| 2,581,558 | 1/1952 | Ruhemann | 62/115 |
| 3,303,660 | 2/1967 | Berg | 62/54 |
| 3,408,824 | 5/1968 | Karboskey et al. | 62/9 |
| 3,411,314 | 11/1968 | Wakeman | 62/219 |
| 3,478,529 | 11/1969 | Boykin | 62/85 |
| 3,545,226 | 12/1970 | Newell | 62/54 |
| 3,763,901 | 10/1973 | Viland | 62/54 |
| 3,808,826 | 5/1974 | Harper et al. | 62/9 |
| 3,895,676 | 7/1975 | Young | 62/39 |

*Primary Examiner*—Ronald C. Capossela

[57] ABSTRACT

The problem of separation of vapors forming a separate phase leaving behind a liquid which then flows at a lower rate is overcome when employing a mixture of vapor and liquid in a heat exchanger by rapidly pushing through preferably on the shell side the mixture of vapor and liquid to prevent substantially formation of undesired separate vapor phase. Preferably, the heat exchanger is disposed vertically, i.e., the mixture of vapor and liquid flows substantially vertically upward. In the now-preferred embodiment the tube bundle is disposed so that the tubes are vertically disposed. Tubes otherwise disposed, e.g., horizontally can also be used.

Apparatus is disclosed comprising in combination with a shell-tube type heat exchanger, a mixed heat exchange medium storage, an expansion device through which the medium is expanded when cooling is desired, vapor and liquid separation means for recovering separately vapor and liquid from used heat exchange medium, and means for reconstituting the mixed-component heat exchange medium and passing the same to said storage.

11 Claims, 2 Drawing Figures

MIXED-COMPONENT REFRIGERATION IN SHELL-TUBE EXCHANGER

Figure 1:
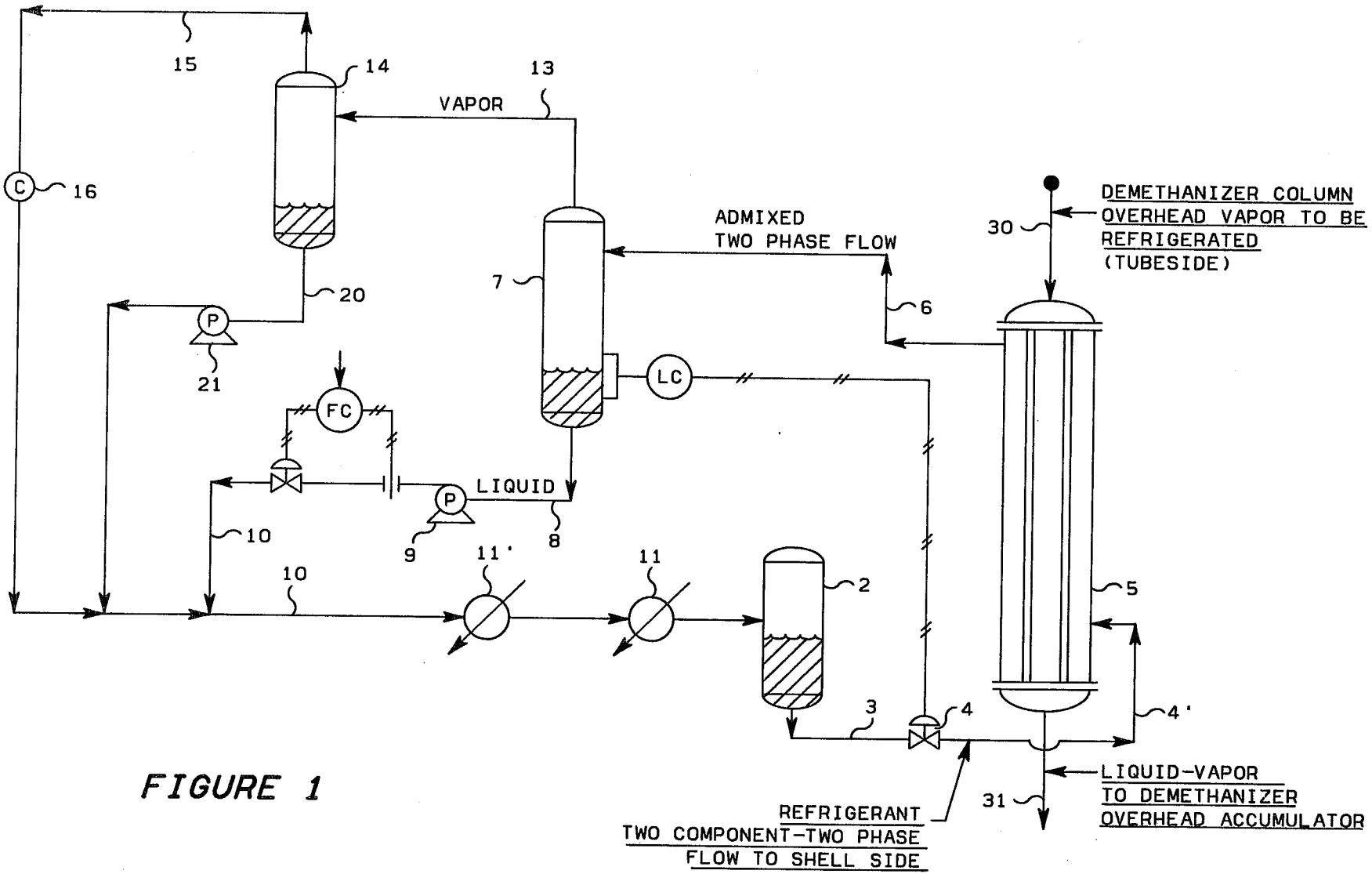

This invention relates to heat exchange. It also relates to the operation of heat exchangers. In a more specific aspect the invention relates to the disposition and operation of a shell-tube heat exchanger. In a further aspect of the invention it relates to the utilization of a mixed vapor-liquid, i.e. mixed-component liquid refrigerant.

In one of its concepts the invention provides a method of operating a shell-tube heat exchanger, employing a heat exchange fluid comprising several components, one of which can separate as a vapor leaving behind a liquid which comprises operating the heat exchanger completely full of a boiling mixture of the heat exchange fluid. In another of its concepts, the method of the invention comprises passing the heat exchange fluid into and through the heat exchanger in amounts sufficient to insure that excess liquid is circulated through the heat exchanger to provide a positive flow of both phases of the heat exchange fluid in the heat exchanger. This means that there is an amount of liquid passing through the heat exchanger which is in excess over the amount of liquid-vapor mixture needed to obtain the desired cooling. In another concept of the invention, the heat exchanger is disposed vertically. That is, the shell and tube bundle are essentially vertically disposed, the heat exchange fluid is pumped in at the bottom and used heat exchange fluid is taken off at the top. In a further concept of the invention, the heat exchange of fluid can be pumped through a vertically or horizontally disposed heat exchanger in subdivided flow, by arranging the heat exchanger apparatus to have several flow paths therethrough, in effect, partitioning the same into a plurality of chambers each having its own inlet and outlet. In such concept, the heat exchange medium, heating fluid or fluid to be heated—which is a mixed component fluid—will be divided into a plurality of streams and the resulting streams passed each of them into and through said separate pathways, respectively.

In heat exchanging employing a mixed-component medium, i.e., a mixture of different boiling point components, as in refrigeration with a liquid refrigerant comprising ethane and propane, problems of poor heat exchange are encountered. The lighter component vaporizes and passes through the exchanger leaving the exchanger while a resulting heavier component remains in the heat exchanger, as in the shell, as a liquid, ultimately becoming ineffective as a refrigerant.

I have now conceived that operating with a boiling pool of mixed-component refrigerant as in the shell side of a heat exchanger which, preferably, is vertically disposed, and by keeping the cold side of the heat exchanger completely full of the liquid, mixed-component refrigerant, efficiencies and economies are considerably improved. The used refrigerant is conducted into a separate vessel in which phase separation occurs. By keeping the heat exchanger completely full of the liquid, mixed-component refrigerant there is no locus in which the predominant or only phase is vapor and there is no way in which a resulting liquid becomes stagnant or appreciably concentrated in heavy component. Thus, in the operation of the invention all of the tubes are active for heat exchange being in contact throughout their lengths with a boiling mixed-component liquid refrigerant.

It is an object of the invention to provide a method of heat exchange. It is another object of the invention to provide a method of heat exchanging in which one of the materials involved in the heat exchange operation is a mixed-component material. A further object of the invention is to provide a method for efficient and economical heat exchange between at least two materials, one of which is a mixed-component medium, i.e., a liquid-vapor mixture, e.g., ethane-propane. A further object of the invention is to provide heat exchange apparatus. A still further object of the invention is to provide for the operation of a heat exchange apparatus in which a mixed-component medium is circulated so as to obtain important efficiencies and economies of heat exchange. Still another object of the invention is to provide a refrigeration process, as in a shell-tube heat exchanger, employing mixed-component liquid refrigerant, e.g., ethane-propane.

Other aspects, concepts, objects and the several advantages of the invention are apparent from a study of this disclosure, the drawing, and the appended claims.

According to the invention there is provided a method or operation for effecting indirect heat exchange in a heat exchange zone between a mixed-component material comprising under conditions of the operation a liquid component and a vapor or a vapor-forming component and another fluid which comprises passing said material into and through said heat exchange zone in a manner to keep said material's side of the exchanger substantially liquid full, thereby preventing separation of a vapor phase which leaves behind, moving at a slower rate, if at all, a liquid which soon becomes ineffective for desirable heat exchange.

Also, according to the invention there is provided an apparatus comprising a shell-tube heat exchanger, a mixed-component storage vessel, means for conveying mixed liquid-vapor heat exchange medium from said storage vessel to said exchanger, a liquid-vapor phase separator, means for conveying from said exchanger used mixed-component (liquid-vapor) heat exchange medium, means for pumping liquid from said liquid-vapor phase separator to said storage vessel and means for conveying vapor from said liquid-vapor phase separator to a liquefaction means and then to said storage vessel.

The concepts of the present invention are especially applicable to refrigeration employing as refrigerant a mixed-component or liquid-vapor mixture of ethane and propane. Accordingly, the invention will be described further in connection with the embodiment in which such a liquid-vapor mixture is employed. For example, the mixed components comprise propane and ethane. The two phases are vapor and liquid, and each phase will comprise both ethane and propane, but in different amounts in each phase. On the shell side, vapors form and are maintained as gas or vapor bubbles within the rapidly flowing liquid refrigerant.

Figure 2:
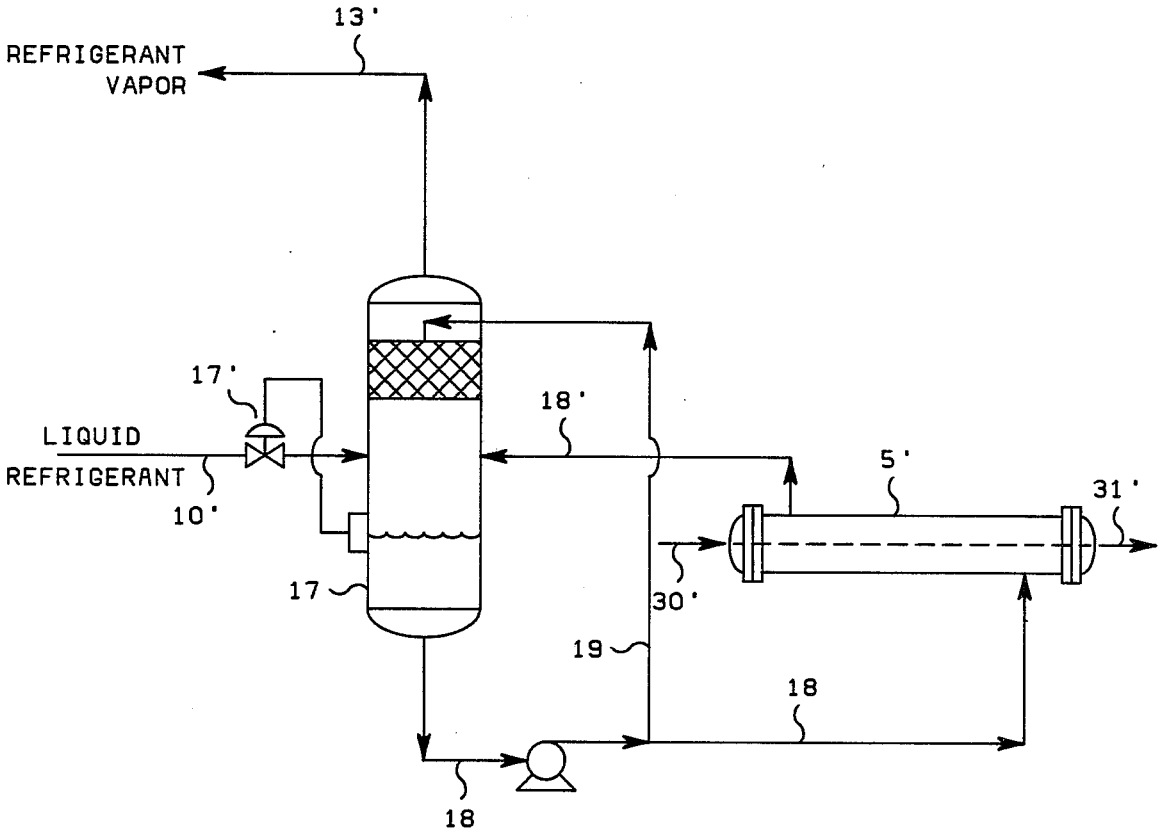

In the drawings are shown diagrammatically in FIGS. 1 and 2 respectively method and apparatus broadly comprising a shell-tube type heat exchanger and associated equipment or apparatus for conveying through the heat exchanger, for example, through the shell side thereof, keeping it liquid full, the liquid refrigerant which, of course, comprises distributed therethrough a vapor component.

Referring now to FIG. 1, a mixture of liquid ethane and propane is conducted from the foot of storage vessel 2 by pipe 3 through expansion valve 4 and via 4' into the shell side of heat exchanger 5. According to the invention the rate of flow is such that in spite of vaporization which tends to occur and does occur within the mixed-component heat exchange medium the entire length of the heat exchanger is kept liquid full, thus avoiding substantially vapor from liquid separation in the heat exchanger. A mixed vapor and liquid is taken off through 6 and conducted into vapor from liquid separator 7. Liquid is taken from separator 7 by 8 and pumped by 9 and through 10 to storage 2. On the way to storage 2 the liquid is refrigerated at 11.

Vapor from separator 7 is passed by 13 into vapor from liquid separator 14 from which vapor is passed by 15 and compressor 16 and through 10, water exchanger 11' and refrigerated exchanger 11, into the storage vessel 2.

Finally, liquid from separator 14 is passed by 20 and pumped by 21, 10, exchanger 11' and exchanger 11 to storage vessel 2.

Fluid to be chilled enters the tubes of exchanger 5 via 30 and is removed at 31.

The following calculated apparatus and operational information is a specific example according to the invention.

| CALCULATED OPERATION | | |
|---|---|---|
| Vessel (10): | | |
| Pressure, gauge, | 208 psi | 1,435 kPa |
| Temperature, | 18° F. | −7.8° C. |
| Diameter | 5 Feet | 1.52 Meters |
| Length, | 9 Feet | 2.74 Meters |
| Vertical Exchanger (5): | | |
| Length of Shell, | 36 Feet | 10.97 Meters |
| Diameter of Shell, | 24 Inches | 0.61 Meters |
| Number of Tubes, | 490 | 490 |
| Diameter of Tubes, | ¾ Inch | 1.9 cm |
| Vessel (7): | | |
| Pressure, gauge, | 16.5 psi | 113.9 kPa |
| Temperature, | −59° F. | −50.6° C. |
| Diameter, | 5 Feet | 1.52 Meters |
| Length, | 9 Feet | 2.74 Meters |
| Vessel (14): | | |
| Pressure, gauge, | 16 psi | 110 kPa |
| Temperature, | −58° F. | −51.7° C. |
| Diameter, | 3.5 Feet | 1.07 Meters |
| Length, | 9 Feet | 2.74 Meters |
| Two Component Refrigerant | | |
| Volume Percent: | | |
| Ethane, | 70 | 70 |
| Propane, | 30 | 30 |
| Refrigerant (4') to Shell: | | |
| Flow Rate, "as liquid", | 460 pounds/min. | 209 KE/min. |
| Temperature | −80° F. | −62.2° C. |
| Pressure, gauge, | 23 psi | 158.7 kPa |
| Velocity through shell, approx., | 15 ft./min. | 4.58 m/min. |
| Vapor (30) to Tubes: | | |
| Flow Rate, | 22,856 lbs./hr. | 10,389 kgm/hr. |
| Temperature, | −4° F. | −20° C. |
| Partially Condensed Product (31): | | |
| Flow Rate, | 22,856 lbs./hr. | 10,389 kgm/hr. |
| Temperature, | −70° F. | −56.7° C. |

Referring now to FIG. 2, the mixture of ethane and propane refrigerant is passed via line 10' through expansion valve 17' into surge tank 17, wherein flashed vapors are separated from the resulting chilled liquid of ethane and propane refrigerant, minimizing the amount of vapor present in this liquid charged via 18 to the shell side of shell-heat tube heat exchanger 5'. A portion of liquid 18 is passed via 19 to wet or flood the mesh, or equivalent contact material, located in vessel 17 above the feed inlet 10' and above the used refrigerant inlet 18'. This liquid 19 is passed to above the contacting mesh, and results in leaner vapors being removed via 13', for recompression, condensing, and recycling to line 10'. Fluid to be chilled is introduced into the tube side of exchanger 5' via 30' and is removed for further handling via 31'.

One skilled in the art in possession of this disclosure having studied the same can readily vary conditions of operation, sizes and structure to suit any particular situation. However, for best results, a rate of flow should be selected which will keep the heat exchange medium as a continuous mass rather than to allow it to separate into vapor and liquid phases.

It is within the scope of the present invention to dispose the heat exchanger other than vertically. A vertical disposition is now preferred. Vertical disposition lends itself readily to maintaining the heat exchange medium containing-side of the heat exchanger liquid full at all times. Nevertheless, depending upon size and configuration and rates of flow of the mixed-component heat exchange medium, it is within the broad concepts and, therefore, within the broad scope of the invention to dispose the heat exchanger at an angle or even horizontally. Bearing in mind the different types of configuration which one may have, the heat exchanger can have vertical tubes disposed within a horizontal shell; horizontal tubes disposed within a horizontal shell; horizontal tubes disposed within a vertical shell and, of course, as described in connection with the drawing and as there shown vertical tubes disposed within a vertical shell. The latter construction and disposition are now preferred as evident from this disclosure.

Reasonable variation and modification are possible within the scope of the foregoing disclosure, drawing, and the appended claims to the invention the essence of which is that a mixed-component liquid heat exchange medium which tends to form a vapor is passed through a heat exchange zone in a manner to keep said zone substantially liquid full at all times, thereby preventing separation of a vapor phase which will leave behind, moving at a slower rate, if at all, a liquid which soon becomes ineffective for desirable heat exchange.

I claim:

1. A method or operation for effecting heat exchange in a heat exchange zone between a liquid mixed-component material comprising under conditions of the operation a liquid component and a vapor or vapor-forming component and another fluid which comprises passing said material into and through said exchange zone in a manner, including a sufficiently rapid flow, to keep the portion of said zone through which said material is passed substantially completely liquid full, thereby preventing separation of a vapor phase which leaves behind, moving at a slower rate, if at all, a liquid which soon becomes ineffective for desirable heat exchange.

2. A method or operation for effecting heat exchange in a heat exchange zone between a liquid mixed-component material comprising under conditions of the operation a liquid component and a vapor or vapor-forming component and another fluid which comprises passing said material into and through said exchange zone in a manner and under conditions of flow to keep the portion of said zone through which said material is passed substantially completely liquid full, thereby preventing separation of a vapor phase which leaves behind, moving at a slower rate, if at all, a liquid which soon becomes ineffective for desirable heat exchange.

3. A method or operation for effecting heat exchange in a heat exchange zone between a liquid mixed-component material comprising under conditions of the operation a liquid component and a vapor or vapor-forming component and another fluid which comprises passing said material into and through said exchange zone in a manner and at a rate of flow sufficient to keep the portion of said zone through which said material is passed substantially completely liquid full, thereby preventing separation of a vapor phase which leaves behind, moving at a slower rate, if at all, a liquid which soon becomes ineffective for desirable heat exchange.

4. A method or operation for effecting refrigerating heat exchange in a heat exchange zone between a liquid mixed-component material comprising a low boiling temperature component, which under conditions of the operation will cause separation of a liquid and a vapor, and another fluid, which comprises passing said material into and through said exchange zone in a manner to keep the portion of said zone through which said material is passed substantially liquid full, thereby preventing separation of a vapor phase which leaves behind, moving at a slower rate, if at all, a liquid which soon becomes ineffective for desirable heat exchange.

5. A method according to claim 4 wherein the mixed-component material includes ethane and propane.

6. A method or operation for effecting refrigerating heat exchange in a heat exchange zone between a liquid mixed-component material comprising ethane and propane which under conditions of the operation tend to separate into a liquid component and a vapor component, and another fluid, which comprises reducing the pressure on a liquid material containing ethane and propane and passing said liquid material into and through said exchange zone in a manner to keep the portion of said zone through which said material is passed substantially liquid full, thereby preventing separation of a vapor phase which leaves behind, moving at a slower rate, if at all, a liquid which soon becomes ineffective for desirable heat exchange.

7. A method according to claim 6 wherein the material is removed from the exchange zone, the vapor now formed therein is separated from the liquid and the vapor and liquid each separately are processed for return for reuse as said liquid mixed-component material.

8. A method according to claim 6 which comprises passing said liquid mixed component material through said portion of said zone at a sufficiently rapid flow to keep said portion substantially completely liquid full.

9. A method according to claim 8 wherein said liquid is passed through said portion at a rate above that needed to obtain the desired heat exchange.

10. A method according to claim 9 wherein said portion is filled with boiling liquid.

11. An apparatus which comprises a storage vessel for storing a liquid, mixed-component refrigerant material; a heat exchanger of the shell-tube bundle type, refrigeration liquid pressure reducing means interposed between said vessel and said exchanger; conduit means for conveying refrigerant from said vessel through said pressure reducing means into and through said exchanger; means for recovering used refrigerant from said exchanger, means for separating used refrigerant into a liquid and a vapor, means for passing said used refrigerant from said exchanger into said means for separating, and means for processing said liquid and said vapor for reconstituting said liquid, mixed-component refrigerant material.

* * * * *

UNITED STATES PATENT AND TRADEMARK OFFICE

CERTIFICATE OF CORRECTION

PATENT NO. : 4,180,123

DATED : December 25, 1979

INVENTOR(S) : Rolland E. Dixon

It is certified that error appears in the above—identified patent and that said Letters Patent is hereby corrected as shown below:

Columns 1 thru 4 should be deleted to appear as per attachment.

Signed and Sealed this

*First* Day of *July 1980*

[SEAL]

*Attest:*

SIDNEY A. DIAMOND

*Attesting Officer*

*Commissioner of Patents and Trademarks*

MIXED-COMPONENT REFRIGERATION IN SHELL-TUBE EXCHANGER

This invention relates to heat exchange. It also relates to the operation of heat exchangers. In a more specific aspect the invention relates to the disposition and operation of a shell-tube heat exchanger. In a further aspect of the invention it relates to the utilization of a mixed vapor-liquid, i.e. mixed-component liquid refrigerant.

In one of its concepts the invention provides a method of operating a shell-tube heat exchanger, employing a heat exchange fluid comprising several components, one of which can separate as a vapor leaving behind a liquid which comprises operating the heat exchanger completely full of a boiling mixture of the heat exchange fluid. In another of its concepts, the method of the invention comprises passing the heat exchange fluid into and through the heat exchanger in amounts sufficient to insure that excess liquid is circulated through the heat exchanger to provide a positive flow of both phases of the heat exchange fluid in the heat exchanger. This means that there is an amount of liquid passing through the heat exchanger which is in excess over the amount of liquid-vapor mixture needed to obtain the desired cooling. In another concept of the invention, the heat exchanger is disposed vertically. That is, the shell and tube bundle are essentially vertically disposed, the heat exchange fluid is pumped in at the bottom and used heat exchange fluid is taken off at the top. In a further concept of the invention, the heat exchange of fluid can be pumped through a vertically or horizontally disposed heat exchanger in subdivided flow, by arranging the heat exchanger apparatus to have several flow paths therethrough, in effect, partitioning the same into a plurality of chambers each having its own inlet and outlet. In such concept, the heat exchange medium, heating fluid or fluid to be heated—which is a mixed component fluid—will be divided into a plurality of streams and the resulting streams passed each of them into and through said separate pathways, respectively.

In heat exchanging employing a mixed-component medium, i.e., a mixture of different boiling point components, as in refrigeration with a liquid refrigerant comprising ethane and propane, problems of poor heat exchange are encountered. The lighter component vaporizes and passes through the exchanger leaving the exchanger while a resulting heavier component remains in the heat exchanger, as in the shell, as a liquid, ultimately becoming ineffective as a refrigerant.

I have now conceived that operating with a boiling pool of mixed-component refrigerant as in the shell side of a heat exchanger which, preferably, is vertically disposed, and by keeping the cold side of the heat exchanger completely full of the liquid, mixed-component refrigerant, efficiencies and economies are considerably improved. The used refrigerant is conducted into a separate vessel in which phase separation occurs. By keeping the heat exchanger completely full of the liquid, mixed-component refrigerant there is no locus in which the predominant or only phase is vapor and there is no way in which a resulting liquid becomes stagnant or appreciably concentrated in heavy component. Thus, in the operation of the invention all of the tubes are active for heat exchange being in contact throughout their lengths with a boiling mixed-component liquid refrigerant.

It is an object of the invention to provide a method of heat exchange. It is another object of the invention to provide a method of heat exchanging in which one of the materials involved in the heat exchange operation is a mixed-component material. A further object of the invention is to provide a method for efficient and economical heat exchange between at least two materials, one of which is a mixed-component medium, i.e., a liquid-vapor mixture, e.g., ethane-propane. A further object of the invention is to provide heat exchange apparatus. A still further object of the invention is to provide for the operation of a heat exchange apparatus in which a mixed-component medium is circulated so as to obtain important efficiencies and economies of heat exchange. Still another object of the invention is to provide a refrigeration process, as in a shell-tube heat exchanger, employing mixed-component liquid refrigerant, e.g., ethane-propane.

Other aspects, concepts, objects and the several advantages of the invention are apparent from a study of this disclosure, the drawing, and the appended claims.

According to the invention there is provided a method or operation for effecting indirect heat exchange in a heat exchange zone between a mixed-component material comprising under conditions of the operation a liquid component and a vapor or a vapor-forming component and another fluid which comprises passing said material into and through said heat exchange zone in a manner to keep said material's side of the exchanger substantially liquid full, thereby preventing separation of a vapor phase which leaves behind, moving at a slower rate, if at all, a liquid which soon becomes ineffective for desirable heat exchange.

Also, according to the invention there is provided an apparatus comprising a shell-tube heat exchanger, a mixed-component storage vessel, means for conveying mixed liquid-vapor heat exchange medium from said storage vessel to said exchanger, a liquid-vapor phase separator, means for conveying from said exchanger used mixed-component (liquid-vapor) heat exchange medium, means for pumping liquid from said liquid-vapor phase separator to said storage vessel and means for conveying vapor from said liquid-vapor phase separator to a liquefaction means and then to said storage vessel.

The concepts of the present invention are especially applicable to refrigeration employing as refrigerant a mixed-component or liquid-vapor mixture of ethane and propane. Accordingly, the invention will be described further in connection with the embodiment in which such a liquid-vapor mixture is employed. For example, the mixed components comprise propane and ethane. The two phases are vapor and liquid, and each phase will comprise both ethane and propane, but in different amounts in each phase. On the shell side, vapors form and are maintained as gas or vapor bubbles within the rapidly flowing liquid refrigerant.

In the drawings are shown diagrammatically in FIGS. 1 and 2 respectively method and apparatus broadly comprising a shell-tube type heat exchanger and associated equipment or apparatus for conveying through the heat exchanger, for example, through the shell side thereof, keeping it liquid full, the liquid refrigerant which, of course, comprises distributed therethrough a vapor component.

Referring now to FIG. 1, a mixture of liquid ethane and propane is conducted from the foot of storage vessel 2 by pipe 3 through expansion valve 4 and via 4' into the shell side of heat exchanger 5. According to the invention the rate of flow is such that in spite of vaporization which tends to occur and does occur within the mixed-component heat exchange medium the entire length of the heat exchanger is kept liquid full, thus avoiding substantially vapor from liquid separation in the heat exchanger. A mixed vapor and liquid is taken off through 6 and conducted into vapor from liquid separator 7. Liquid is taken from separator 7 by 8 and pumped by 9 and through 10 to storage 2. On the way to storage 2 the liquid is refrigerated at 11.

Vapor from separator 7 is passed by 13 into vapor from liquid separator 14 from which vapor is passed by 15 and compressor 16 and through 10, water exchanger 11' and refrigerated exchanger 11, into the storage vessel 2.

Finally, liquid from separator 14 is passed by 20 and pumped by 21, 10, exchanger 11' and exchanger 11 to storage vessel 2.

Fluid to be chilled enters the tubes of exchanger 5 via 30 and is removed at 31.

The following calculated apparatus and operational information is a specific example according to the invention.

| CALCULATED OPERATION | | |
|---|---|---|
| Vessel (10): | | |
| Pressure, gauge, | 208 psi | 1,435 kPa |
| Temperature, | 18° F. | −7.8° C. |
| Diameter | 5 Feet | 1.52 Meters |
| Length, | 9 Feet | 2.74 Meters |
| Vertical Exchanger (5): | | |
| Length of Shell, | 36 Feet | 10.97 Meters |
| Diameter of Shell, | 24 Inches | 0.61 Meters |
| Number of Tubes, | 490 | 490 |
| Diameter of Tubes, | ¾ Inch | 1.9 cm |
| Vessel (7): | | |
| Pressure, gauge, | 16.5 psi | 113.9 kPa |
| Temperature, | −59° F. | −50.6° C. |
| Diameter, | 5 Feet | 1.52 Meters |
| Length, | 9 Feet | 2.74 Meters |
| Vessel (14): | | |
| Pressure, gauge, | 16 psi | 110 kPa |
| Temperature, | −58° F. | −51.7° C. |
| Diameter, | 3.5 Feet | 1.07 Meters |
| Length, | 9 Feet | 2.74 Meters |
| Two Component Refrigerant | | |
| Volume Percent: | | |
| Ethane, | 70 | 70 |
| Propane, | 30 | 30 |
| Refrigerant (4') to Shell: | | |
| Flow Rate, "as liquid", | 460 pounds/min. | 209 KE/min. |
| Temperature | −80° F. | −62.2° C. |
| Pressure, gauge, | 23 psi | 158.7 kPa |
| Velocity through shell, approx., | 15 ft./min. | 4.58 m/min. |
| Vapor (30) to Tubes: | | |
| Flow Rate, | 22,856 lbs./hr. | 10,389 kgm/hr. |
| Temperature, | −4° F. | −20° C. |
| Partially Condensed Product (31): | | |
| Flow Rate, | 22,856 lbs./hr. | 10,389 kgm/hr. |
| Temperature, | −70° F. | −56.7° C. |

Referring now to FIG. 2, the mixture of ethane and propane refrigerant is passed via line 10' through expansion valve 17' into surge tank 17, wherein flashed vapors are separated from the resulting chilled liquid of ethane and propane refrigerant, minimizing the amount of vapor present in this liquid charged via 18 to the shell side of shell-heat tube heat exchanger 5'. A portion of liquid 18 is passed via 19 to wet or flood the mesh, or equivalent contact material, located in vessel 17 above the feed inlet 10' and above the used refrigerant inlet 18'. This liquid 19 is passed to above the contacting mesh, and results in leaner vapors being removed via 13', for recompression, condensing, and recycling to line 10'. Fluid to be chilled is introduced into the tube side of exchanger 5' via 30' and is removed for further handling via 31'.

One skilled in the art in possession of this disclosure having studied the same can readily vary conditions of operation, sizes and structure to suit any particular situation. However, for best results, a rate of flow should be selected which will keep the heat exchange medium as a continuous mass rather than to allow it to separate into vapor and liquid phases.

It is within the scope of the present invention to dispose the heat exchanger other than vertically. A vertical disposition is now preferred. Vertical disposition lends itself readily to maintaining the heat exchange medium containing-side of the heat exchanger liquid full at all times. Nevertheless, depending upon size and configuration and rates of flow of the mixed-component heat exchange medium, it is within the broad concept and, therefore, within the broad scope of the invention to dispose the heat exchanger at an angle or even horizontally. Bearing in mind the different types of configuration which one may have, the heat exchanger can have vertical tubes disposed within a horizontal shell; horizontal tubes disposed within a horizontal shell; horizontal tubes disposed within a vertical shell and, of course, as described in connection with the drawing and as there shown vertical tubes disposed within a vertical shell. The latter construction and disposition are now preferred as evident from this disclosure.

Reasonable variation and modification are possible within the scope of the foregoing disclosure, drawing, and the appended claims to the invention the essence of which is that a mixed-component liquid heat exchange medium which tends to form a vapor is passed through a heat exchange zone in a manner to keep said zone substantially liquid full at all times, thereby preventing separation of a vapor phase which will leave behind, moving at a slower rate, if at all, a liquid which soon becomes ineffective for desirable heat exchange.

I claim:

1. A method or operation for effecting heat exchange in a heat exchange zone between a liquid mixed-component material comprising under conditions of the operation a liquid component and a vapor or vapor-forming component and another fluid which comprises passing said material into and through said exchange zone in a manner, including a sufficiently rapid flow, to keep the portion of said zone through which said material is passed substantially completely liquid full, thereby preventing separation of a vapor phase which leaves behind, moving at a slower rate, if at all, a liquid which soon becomes ineffective for desirable heat exchange.

2. A method or operation for effecting heat exchange in a heat exchange zone between a liquid mixed-component material comprising under conditions of the operation a liquid component and a vapor or vapor-forming component and another fluid which comprises passing said material into and through said exchange zone in a manner and under conditions of flow to keep the portion of said zone through which said material is passed substantially completely liquid full, thereby preventing separation of a vapor phase which leaves behind, mov-